United States Patent [19]

Morrison

[11] 4,288,671

[45] Sep. 8, 1981

[54] AUTOMATIC WASHER TIMER DIAL PROTECTIVE SHIELD

[75] Inventor: Russell J. Morrison, St. Joseph, Mich.

[73] Assignee: Whirlpool Corporation, Benton Harbor, Mich.

[21] Appl. No.: 111,715

[22] Filed: Jan. 14, 1980

[51] Int. Cl.[3] ..... H01H 9/16; H01H 19/00

[52] U.S. Cl. ..... 200/304; 200/308; 200/38 A; 74/548

[58] Field of Search ..... 200/304, 38 A, 38 F, 200/334, 308, 293; 116/311; 68/12 R; 74/553, 548

[56] References Cited

U.S. PATENT DOCUMENTS

| | | | |
|---|---|---|---|
| 2,501,008 | 3/1950 | Schramm | 74/548 |
| 2,825,772 | 3/1958 | Jones | 74/548 |
| 2,933,581 | 4/1960 | Naimer | 200/308 |
| 3,114,013 | 12/1963 | Morschel | 200/38 A |
| 3,210,040 | 10/1965 | Thurlow | 74/548 |
| 3,393,657 | 1/1964 | Fukunishi | 116/249 |
| 3,473,408 | 10/1969 | Bettinger | 74/553 |
| 3,566,063 | 2/1971 | McConnell | 200/308 |
| 3,902,375 | 9/1975 | Herrick et al. | 74/553 |

*Primary Examiner*—John W. Shepperd

*Attorney, Agent, or Firm*—Hill, Van Santen, Steadman, Chiara & Simpson

[57] ABSTRACT

A means for preventing the bypassing of the timer protective mechanisms in an automatic washing machine is provided by a shield freely rotatable on the timer shaft fully covering the indicator dial across its face and over its edges and being transparent so as to allow the indicator to be seen, while preventing manual access to the control components associated with the timer shaft.

7 Claims, 3 Drawing Figures

AUTOMATIC WASHER TIMER DIAL PROTECTIVE SHIELD

BACKGROUND OF THE INVENTION

1. Field of the Invention

This invention relates to automatic washing machines of the type having a presettable sequential control means operable through a series of washing, rinsing, and extracting periods of a laundry program and more specifically to a protective means for preventing advancement of the control means by the user while the washing machine is in operation.

2. Description of the Prior Art

A means for removing the indicator of a timer control mechanism is shown in U.S. Pat. No. 3,566,063 wherein the indicator is placed behind a window in the console of a washing machine. This placement however requires a lighting means to clearly view the indicator.

A clear control knob is shown in U.S. Pat. No. 3,393,657 which is independent from a concentric control knob, however it does not prevent the other knob from being operated.

A clear fine tuning ring is shown in U.S. Pat. No. 3,902,375 which is partially independent from a concentric control knob, however, it does not prevent the other knob from being operated.

A clear cover is shown in U.S. Pat. No. 2,933,581 which is not independent from the indicator nor does it prevent the indicator from being operated.

SUMMARY OF THE INVENTION

In an appliance having a mechanical timer, cam set mechanism it is important that the user of the appliance, especially an automatic washer, not be able to advance the cam set when the appliance is in operation since the rapid changing of the on/off condition of the various operating components can cause failure because of the undue load created on the components. Presently, cam sets are utilized which provide a clutch mechanism to disconnect the control knob from the cam set when the knob is pushed or pulled to start the appliance and in the off position provides a one-way clutch mechanism to prevent the cams from being rotated in a reverse direction. Thus, a user of the appliance can only rotate the cam set in the off position in the proper direction to set the function desired, and in the on or operating position cannot rotate the cam set at all.

However, a difficulty arises when an indicator is provided to show the user where in the cycle the appliance is to be set or is operating during the cycle. This indicator must be attached or indexed to the cam set body so as to always give a correct indication of the cam set position. Thus, the indicator should not be connected to the operating knob because the knob is free to be rotated separate from the cam set and cannot give a correct cam set position indication. In some structures, the user is able to bypass the protective clutch mechanism in the knob by grasping the indicator dial and rotating the cam set in either direction with or without the appliance operating.

To prevent the bypassing of the protective clutch mechanisms, the present invention provides a shield freely rotatable independently from the cam set fully covering the indicator dial across its face and over its edges. The shield is transparent so as to allow the indicator marking to be seen and is free to rotate so that grasping the shield does not allow rotation of the cam set. Thus, the user is prevented by the shield and the knob protective mechanism from improperly rotating the cam set, and thus prevented from damaging the appliance through improper cam set manipulation.

DESCRIPTION OF THE PREFERRED EMBODIMENTS

Figure 1:
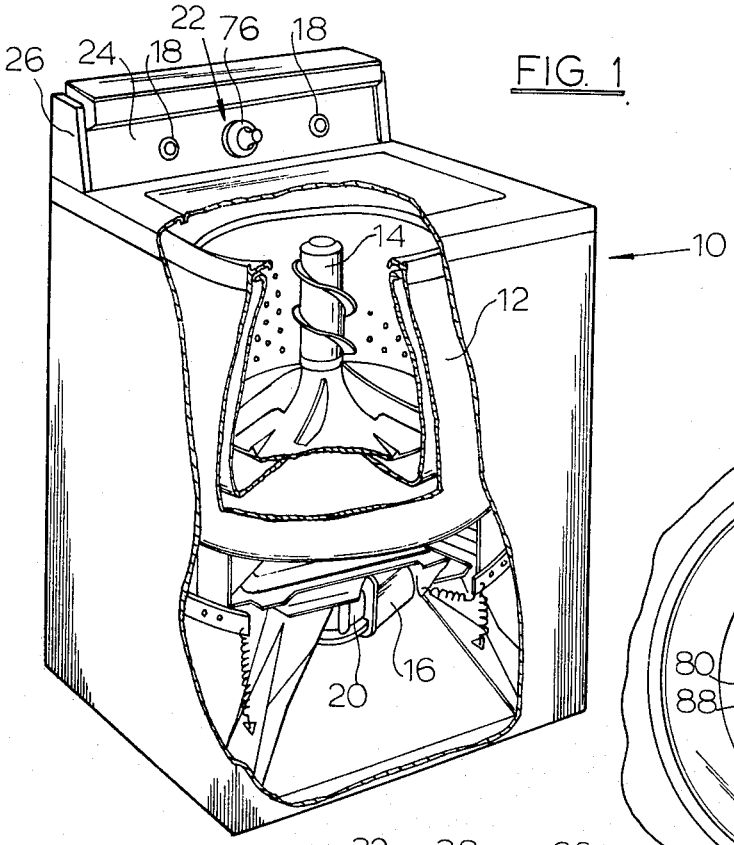
FIG. 1 is a perspective view of an automatic washing machine having a pre-settable sequential control means and a user controllable indicator dial.

In FIG. 1 a washing machine is generally shown at 10 as having a tub 12 with a vertical agitator 14 therein, a water supply (not shown), a power supply (not shown), an electrically driven motor 16 operably connected via a transmission 20 to the agitator 14, and controls 18 including a pre-settable sequential control means 22 for use in selectively operating the washing machine 10 through a programmed sequence of washing, rinsing and extracting steps. The control means 22 is mounted to a panel 24 of a console 26 on the washing machine 10.

Figure 2:
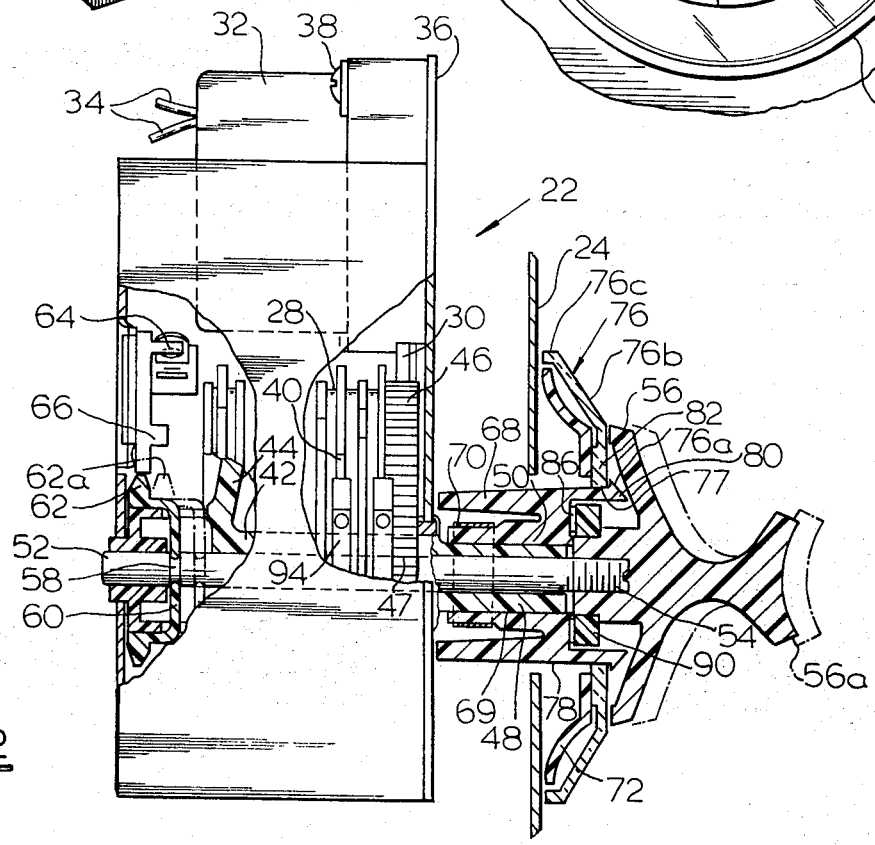
FIG. 2 is a cross-sectional and partial view of the pre-settable sequential control means taken along lines II—II of FIG. 1, and showing a second stable position for the control knob in phantom.

Referring to FIG. 2, the control means 22 is shown in greater detail. The timing of the various steps of washing, rinsing and extracting, is controlled by a rotatable cam set 28 which is rotated by a drive pawl 30 which is in turn operated by a driving motor 32. The driving motor 32 is supplied with electricity through leads 34 and is secured to a mounting plate 36 by appropriate attachment means 38.

Figure 3:
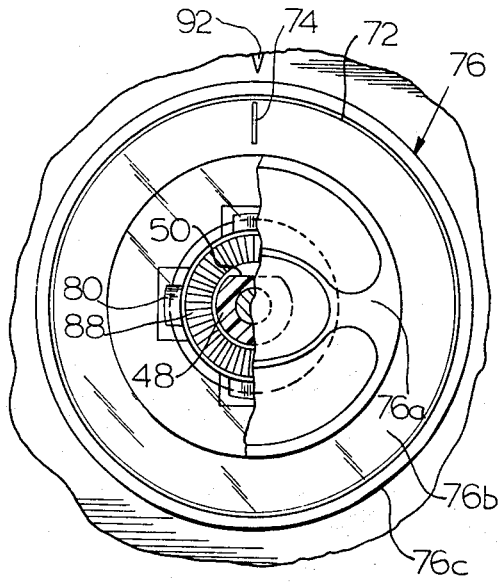
FIG. 3 is a front view partially cut-away of the control knob and cam set of FIG. 2.

The cam set 28 is comprised of a plurality of cams 40 integrally molded to a sleeve means or shaft 42 by means of a web portion 44. At an end of the cam set is formed a ratchet wheel 46 which is also carried on the web portion and which has ratchet teeth 47 on an outer circumference thereof and which are engageable with the drive pawl 30. The sleeve 42 is aligned along an axis 49 and extends axially beyond the ratchet wheel 46 forming a neck 48 which is generally in the shape of a hollow cylinder having a flat key surface 50 as seen in FIG. 3.

A cylindrical rod 52 aligned with the axis 49 and freely rotatable within the sleeve 42 of the cam set 28 extends axially beyond the sleeve 42 on one end and beyond the neck portion 48 on the other end. The end of the rod 52 which extends beyond the neck portion contains a threaded portion 54 to receive and frictionally retain a knob member 56. The opposite end of the rod 52 which extends axially beyond the sleeve 42 contains a circumferential groove 58 which receives and retains fingers 60 of an activator 62.

The knob 56 and therefore the rod 52 and the activator 62 may move slidingly in an axial direction within the shaft 42 of the cam set 28 as is shown in broken lines **56*a* of the knob and broken lines 62*a* of the activator. When the knob 56 is in the solid line position, the activator 62 causes a contact 64 to open by means of pressing against a connecting member 66. The contact 64, when opened, causes a break in the power supply to the washing machine 10 which results in a suspension of mechanical operation of the machine. Thus, this is the off position. When the knob is in the on position shown in broken lines 56***a*, the activator 62*a* is not in contact with the connecting member 66 and in this position the contact 64 is biased to a closed position, resuming the power supply connection.

A dial support member 68 is provided with a female key aperture 69 to slidingly mate with the neck portion flat surface 50 of the sleeve 42 and to rotate in concert therewith about the axis 49. A retaining ring 70 is provided to retain the dial support member 68 in fixed relationship to the neck portion 48. An indicator dial 72 is integrally formed on the dial support member 68. The dial 72 extends radially beyond the dial support member and is positioned on the outside of the panel 24 of the console 26. On the dial 72 is an indicator marking 74 as best seen in FIG. 3, to indicate the relative position of the cam set 28 with respect to the panel 24.

Interposed between the knob member 56 and the dial 72 is a protective shield means 76. The shield means 76 has a ring-like annular body member 76*a* having a central aperture 77 sized to be received on an outer circumferential surface 78 of the dial support member 68 in relatively rotatable relation. The dial support member 68 is provided with a plurality of generally axially aligned fingers 80, each having a small radially extending lip portion 82 which retain the shield means 76 in place. The fingers 80 are made of a resilient material such as a plastic material which permits the fingers to bend radially inward during assembly allowing the shield means to slide over the lip portion 82 of the finger 80 which will then spring back to a rest position and will capture and retain the shield means 76.

The body member 76*a* of the shield means 76 extends radially outwardly from the axis 49 and includes a portion 76*b* which extends radially and longitudinally to fully encompass the dial 72, including a flanged rim 76*c* lying concentrically outwardly of the dial 72. The shield means 76 is also freely rotatable about the axis 49 independent of the dial support member 68. The shield means 76 is made of a transparent plastic material so that when viewing the dial 72 from the front of the washing machine 10, the indicator marking 74 is visible to a user. Thus, the shield means 76 is somewhat cup-shaped to embrace and prevent manual access to any manually graspable control components of the timer associated with the sleeve 42.

Formed on an inner surface 86 of the dial support member 68 perpendicular to the axis 49 is an annular set of ratchet teeth 88 as best seen in FIG. 3. A ratchet ring 90 is juxtaposed between the knob 56 and the ratchet teeth 88. The ratchet teeth 88 receive and are driven by the ratchet ring 90 in a one-way rotational clutching type manner.

In operation, the user of the washing machine 10 pushes the knob 56 into the solid line position which causes contact 64 to open thus interrupting the power supply to the washing machine 10. When the knob 56 is in the solid line position, the ratchet ring 90 is matingly held against the ratchet teeth 88 in a driving relationship. When the user rotates the knob 56, the ratchet ring 90 causes the dial member 68 and thus the dial 72 to rotate in a like manner. The user rotates the knob until the indicator marking 74 is adjacent a function marking on panel 24 which is representively shown at 92. These function markings 92 represent various steps in the operation sequence such as washing, rinsing and extracting steps. As the knob 56 and the dial 72 are rotated, the cam set 28 is also rotated since the neck portion 48 is keyed to the dial support member 68. As the cam set 28 rotates the cams 40, which are of varying heights along their circumferential length, contacts 94 are caused to open or close. These contacts 94 are connected to various circuits (not shown) which control the washing, rinsing and extracting steps. When the user has rotated the knob 56 so as to align the indicator marking 74 with the desired function marking 92, the user pulls the knob 56 to the broken line position 56*a* which allows the contact 64 to close re-establishing the circuit between the power supply and the washer 10. Power is then supplied to the leads 34 of the driving motor 32 which comprises a timing mechanism and which operates the drive pawl 30 resulting in the automatic rotation of the cam set 28 at an appropriate speed.

It is desired that when the knob 56*a* is in the broken line or the on position, that the user be unable to rotate the cam set 28. Rotation of the cam set 28 while the washing machine 10 is functioning, could result in undue load created on the various components of the washing machine 10. Since the dial 72 through support member 68 is necessarily keyed to the cam set 28 in order to show via the indicator marking 74 which function is being performed, any manual rotation of the dial 72 would result in rotation of the cam set 28. The protective shield means 76 fully encompasses and prevents the user from rotating the dial 72 while the knob 56*a* is in the on position since the protective shield means 76 is able to freely rotate independently of the dial 72 and dial support 68. Also, while the knob 56*a* is in the on position, the ratchet ring 90 is disengaged from the ratchet teeth 88 and thus the knob 56*a* and the rod 52 are able to rotate freely independently of the dial support member 68 and the cam set 28.

As is apparent from the foregoing specification, the invention is susceptible of being embodied with various alterations and modifications which may differ particularly from those that have been described in the preceeding specification and description. It should be understood and I wish to embody within the scope of the patent warranted hereon all such modifications as reasonably and properly come within the scope of my contribution to the art.

The embodiments of the invention in which an exclusive property or privilege is claimed are defined as follows:

1. In an automatic washer having a timer including a manually and automatically driven cam set for operating said washer through a sequence of washing operations and mounted within a console, a timer positioning and indicating mechanism comprising:

an indicator dial and integral dial support member affixed to said cam set for indicating its rotational position relative to said console, said indicator spaced outwardly from a front face of said console on a longitudinal axis of said cam set;

a manually operable knob selectively interconnectable with said cam set for one-way rotation of said cam set and said dial when connected, said knob spaced axially outwardly from said dial; and a timer dial protective shield mounted in a freely rotatable manner about said dial support member and extending outwardly from said axis to fully encompass said dial, said position indicated by said dial visible through said shield.

2. For use in a domestic electrical appliance having a manually rotatable shaft driven cam set for operating said appliance through a timed sequence of operations, a timer positioning and indicating mechanism comprising:

an indicator dial concentrically mounted about a longitudinal axis of said shaft and cooperatively rotatable with said shaft for indicating said shaft's relative rotational position and thus indicating which operation said appliance is performing;

a manually selectively operable knob having engaged and disengaged positions rotatably and disengagable connected to said shaft for one-way rotation of said shaft and said dial when said knob is in an engaged position, said knob spaced axially outwardly from said dial; and a timer dial protective shield and means attached to said indicator dial for supporting said protective shield for free rotation about said axis of said shaft, said protective shield extending radially outwardly from said axis of said shaft to fully encompass said dial to prevent access to said dial for manual rotation by a user when said knob is in said disengaged position.

3. A timer positioning and indicating mechanism of claim 2 wherein said timer dial protective shield is made of transparent material to allow said dial to be visible through said shield.

4. A rotary switch having an axially rotatable sleeve means for selectively operating said switch comprising:

a manually selectively operable knob having engaged and disengaged positions rotatably and disengageably connected to said sleeve means for rotation of said sleeve means when said knob is in an engaged position, said knob being positioned at an end of said sleeve means;

an indicator dial concentrically affixed to and cooperatively rotatable with said sleeve means for indicating said sleeve means' position relative to said switch, said dial spaced axially inward of said knob on said sleeve means; and a dial protective shield supported for free axial rotation on said sleeve means between said dial and said knob, said protective shield extending radially outwardly from said sleeve means to fully encompass said dial, whereby said dial cannot be manually rotated by a user when said knob is in said disengaged position.

5. A panel mounted rotary switch and indicator having an axially rotatable shaft means for selectively operating said switch, said rotary switch and indicator comprising:

a manually selectively operable knob connected to said shaft, on an opposite side of said panel from said rotary switch and having engaged and disengaged positions relative to said shaft;

an indicator dial mounted on a dial support member which is affixed to and cooperatively rotatable with said shaft, said dial spaced between said panel and said knob on said shaft; and a dial protective shield supported on said dial support member for free rotation about the axis of said shaft juxtaposed between said dial and said knob, said protective shield extending radially outwardly from said shaft to fully encompass said dial, whereby said dial cannot be manually rotated by a user when said knob is in said disengaged position.

6. In a presettable sequential control means for a domestic appliance of the type including:

a timer actuator rod axially movable between a first engageable position for presetting the control components of the time and a second inactive position wherein the rod is free rotatable;

the improvement of a support member secured to said rod integrally carrying a control component, and supporting a protective shield for free rotation about said rod, said shield sized and shaped to embrace any manually graspable control components of the timer associated with the rod, thereby to prevent rotational adjustment of the control components except by said rod when in said first engageable position.

7. The invention of claim 6 wherein said protective shield is a centrally apertured disc freely rotatable about said support member and having an annular concentric portion extending radially and axially and being peripherally flanged to form a cup-shaped configuration, thereby to embrace any adjoining control components.

* * * * *